United States Patent [19]

Hawkins

[11] 3,965,646

[45] June 29, 1976

[54] ADJUSTABLE SEALING DEVICE

[75] Inventor: Robert Stanley Hawkins, Spartanburg, S.C.

[73] Assignee: W. R. Grace & Co., Duncan, S.C.

[22] Filed: Feb. 26, 1975

[21] Appl. No.: 553,388

[52] U.S. Cl. ..... 53/112 B; 53/86

[51] Int. Cl.[2] ..... B65B 31/02

[58] Field of Search ..... 53/7, 22 B, 86, 112 B; 251/326

[56] References Cited

UNITED STATES PATENTS

| | | | |
|---|---|---|---|
| 2,803,427 | 8/1957 | Wood | 251/326 |
| 3,170,670 | 2/1965 | Johnstone | 251/326 X |
| 3,832,824 | 9/1974 | Burrell | 53/22 B |

*Primary Examiner*—Travis S. McGehee
*Attorney, Agent, or Firm*—John J. Toney; William D. Lee, Jr.

[57] ABSTRACT

Disclosed is an adjustable sealing device for sealably receiving a flexible receptacle, including a wall having an aperture disposed therethrough and a gate for closing variable portions of the aperture and having a recess adapted to traverse the aperture to form a variable size opening through the device, the opening being effective to receive a receptacle therethrough and being sealable by the receptacle. The device is adapted to form a seal between the gate and the wall and to guide the gate. Also disclosed are improvements in known apparatus and methods for vacuumizing bags and other receptacles.

13 Claims, 7 Drawing Figures

ADJUSTABLE SEALING DEVICE

This invention relates to an adjustable sealing device and an improved process and apparatus for evacuating receptacles, especially impervious, flexible receptacles such as thermoplastic bags amd pouches. The invention has particular application in the vacuum packaging of fresh and frozen food products such as beef, poultry, ham, cheese, etc.

In U.S. Pat. No. 1,142,180 Knox discloses a hollow rectangular plate which is arranged to slide within an inner wall of a frame. U.S. Pat. No. 3,760,593 (Whipps) discloses a slide gate for mounting over a wall opening. A slide valve having a concave recess is shown in U.S. Pat. No. 2,803,427 to Woods.

A number of methods are available in the prior art for packaging food products such as meat and poultry in flexible containers such as thermoplastic pouches and bags. In some methods the product is placed in a bag, a vacuumizing nozzle is then inserted into the bag, the mouth of the bag is gathered around the nozzle while the vacuum acting through the nozzle withdraws air from the bag, and after evacuation is completed the bag is either clamped shut with a metal clip or heat welded shut. In this method complete evacuation of the bag is difficult to obtain in that crevices in the surface of the meat form a pocket with the bag wall, thereby trapping air in the bag.

Other prior art packaging methods employ a vacuum chamber into which a filled impervious bag or pouch is placed in open condition. Subsequent evacuation of the chamber also evacuates the bag; and, before the chamber is opened, the bag is sealed or closed within the chamber. An apparatus for carrying out the foregoing steps is disclosed in U.S. Pat. No. 2,790,284 to Hultkrans. The immediately foregoing method and apparatus have not been entirely satisfactory for evacuation of a bag filled with a crevice-containing product such as poultry and many cuts of meat. Another prior art method and apparatus for evacuating a filled bag within a vacuum chamber is disclosed in U.S. Pat. No. 3,714,754 to Holcombe et al.

In U.S. Pat. No. 3,832,824, Burrell discloses an apparatus for evacuating and closing flexible impervious receptacles such as pouches, bags, and the like which have at least one opening and contain at least one product. The apparatus comprises a first vacuum chamber, a second vacuum chamber adjacent to the first chamber, aperture means connecting the chambers for passing the portion of the receptacle containing an opening therethrough, means to evacuate the first and second chambers independently of each other, and means to close the receptacle when its evacuation is completed.

The above-cited Burrell patent also discloses a process of evacuating filled receptacles such as thermoplastic bags, pouches, and the like by placing the filled portion of the bag in a first vacuum chamber, extending the neck of the bag into a second and adjacent vacuum chamber, evacuating the first chamber thereby causing the bag to balloon outwardly away from the product; and, while said first chamber is being evacuated, evacuating the second chamber and, consequently, evacuating the interior of the ballooned bag; thereafter when evacuation of the bag is complete, elevating the pressure in the first chamber to collapse the bag firmly around the product and immediately closing the bag, thereby making an evacuated package.

It has now been found that numerous improvements over heretofore known packaging methods and apparatus are effected simply and efficiently by practice of the present invention, which provides a versatile adjustable sealing device adapted to effectively seal about flexible receptacles throughout a broad range of receptacle sizes.

Generally stated, in one aspect the present invention is for an adjustable sealing device for sealably receiving a flexible receptacle, comprising, in combination:

a. a wall having an aperture disposed therethrough;

b. a gate for closing variable portions of the aperture, said gate being movably received adjacent the wall and adapted to traverse the aperture to and from a first station, said gate having a recess adapted to traverse the aperture simultaneously with traverse thereof by the gate, said recess adapted to cooperate with the aperture to form a variable size opening through the device, said opening being effective to receive a receptacle therethrough and being sealable by the receptacle;

c. seal means for forming a seal between the gate and the wall about the aperture; and d. guide means for guiding the gate in a traverse of the aperture.

In another aspect, generally stated this invention is for an improvement in an apparatus for evacuating and closing flexible, impervious receptacles such as pouches, bags and the like which have at least one opening and contain at least one product, the apparatus comprising:

A. a first vacuum chamber;

B. a second vacuum chamber adjacent to said first chamber;

C. aperture means connecting said chambers for passing the portion of the package containing an opening therethrough;

D. means to evacuate the first and second chambers independently of each other; and, E. means to close the receptacle when its evacuation is completed, the improvement for effecting an improved seal between said chambers throughout a range of receptacle size wherein the aperture means includes the adjustable sealing device of the present invention.

In another aspect, generally stated this invention is for an improvement in a process of evacuating and closing flexible, impervious receptacles such as pouches, bags and the like which have at least one opening and contain at least one product, comprising the steps of:

A. confining a product containing portion of the receptacle within a first region;

B. confining a portion of the receptacle which contains said opening in a second region so that the interior of the receptacle is in communication with the second region through the opening;

C. reducing the pressure within the first region to a first pressure level to move at least a part of the receptacle away from the product; and, subsequently, D. reducing the pressure within the second region to a second pressure level of lower pressure than the first pressure level to effect evacuation of the interior of said receptacle and collapse of the product containing portion of the receptacle into contact with the product; and, thereafter, E. closing the opening to make an evacuated sealed package, the improvement including separating the first and second regions by the above-described adjustable sealing device of this invention with a third portion of said receptacle which connects said receptacle portions in (A) and (B) above received through the wall aperture.

The present invention will be better understood by reference to the following detailed description taken with the accompanying drawing.

As used herein, the following terms appearing within quotation marks have the meaning indicated therefor:

"Receptacle" means a container for receiving an article or product to be packaged therein and includes but is not limited to bags, pouches, and the like.

"Bag" means a receptacle constructed from tubular stock by sealing one end of the tube. A bag may be pleated or gusseted.

"Pouch" means a receptacle constructed from one or more sheets of sheet stock. A pouch may be made, for example, by folding a single sheet and sealing the free edges of the sheet together.

"Aperture" means a hole through a wall and may be of any suitable shape, including but not limited to slot, oval, circular, rectangular, and irregular shapes. An aperture may be formed by joining two wall sections that have recesses in one or both of the surfaces so joined.

"Vacuum" means a pressure level lower than atmospheric pressure which usually is about 14.7 lbs./sq. in. (pounds per square inch) or about 30 in. Hg (inches of mercury). A "high" vacuum means a very low pressure level.

"Heat shrinkable" when used with reference to a material means that the material shrinks upon the application of heat.

"Heat sealable" when used with reference to a material means that the material welds to itself under the influence of temperature, pressure, or temperature and pressure.

"Opening" in a receptacle means a passageway from the exterior of the receptacle to the interior thereof; and, in the case of a bag, the opening can be the mouth of the bag. The portion of the bag containing the opening is referred to herein as the neck of the bag.

Figure 1:
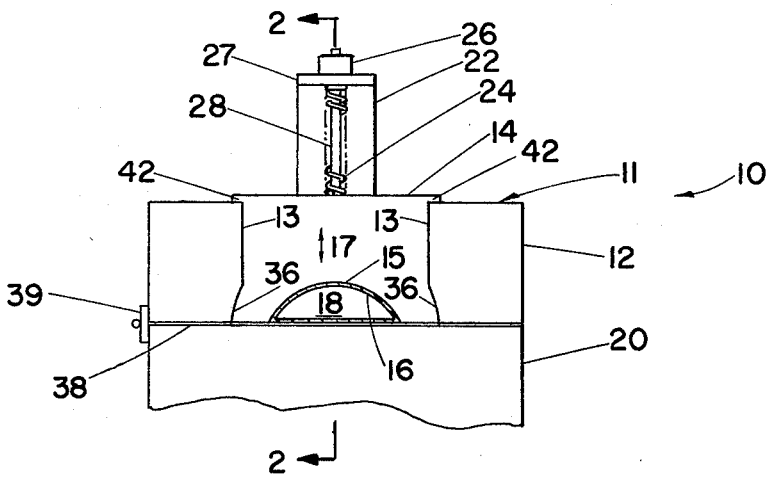
FIG. 1 is an elevation view illustrating a preferred embodiment of the adjustable sealing device of the present invention having a mounting assembly atop the device, with a small bag neck received in sealed relation through the device.

Referring now to the drawing and especially FIG. 1, there is shown adjustable sealing device 10 which comprises wall assembly 11 including depending wall 12 having an aperture disposed therethrough. The aperture is defined in part by two opposite surfaces 13 provided on the wall, the surfaces desirably having arcuate ends 36. The adjustable sealing device further includes gate 14 for closing variable portions of the aperture, the gate being movably received vertically along opposite side portions 42 thereof adjacent the wall by guide means including generally U-shape channels 44 disposed in the wall which are illustrated in plan view in FIG. 3. The wall assembly may be of generally L-shape construction having wall portion 40 integrally formed with the depending wall.

The gate is provided with recess 15, preferably generally arcuate as illustrated, which cooperates with the aperture to form an opening through the device. The opening is found highly effective to sealably receive flexible receptacles therethrough as illustrated in FIG. 1 by the section view of the neck of small flexible thermoplastic bag 16 in sealed relation to the recess.

The device may further include a mounting assembly atop thereof including mount 22 which is secured at a lower end thereof by one or more threaded fasteners 30 to the wall portion or platform 40 through one or more threaded holes 34. Included in the mounting assembly are pin 28 and helical coil spring 24 which extends from an upper end thereof secured to spring stop 26 and terminates at a lower end thereof atop the gate. The pin is provided coaxially of the spring, the pin terminating at a lower end thereof secured by suitable thread means to threaded pin hole 32 provided in the top of the gate and extending through and above the spring stop in slidable engagement therewith. The illustrated mounting assembly is found to be a suitable bias means for biasing the gate to the station or position shown in FIG. 1 and FIG. 2.

Figure 2:
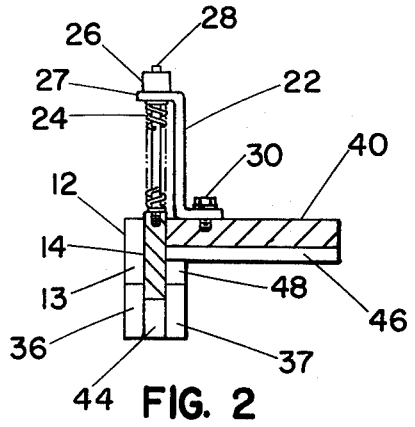
FIG. 2 is a section view of the device taken on line 2—2 of FIG. 1.

In a preferred embodiment adjustable sealing device 10 is removably disposed atop lower wall 20 preferably having secured thereto a resilient member such as gasket 38 of suitable resilient sealing material such as foam rubber or the like. In another embodiment a lower wall illustrated by wall 20 is formed integrally with the present sealing device, the lower wall being a lower portion of wall 12. In another embodiment a lower wall is included as a component of the device and may be pivotally connected to the aperture containing wall by means of hinge 39 or the like. Wall 20 may include a recess not shown which may generally correspond to and mate with recess 15. FIG. 1 and FIG. 2 illustrate an arrangement wherein the device is shown at a first station at which the gate is at a lower position of its traverse of the aperture, arrow 17 indicating the direction of traverse. In the illustrated arrangement the small neck of a bag is ballooned into engagement with the gate contiguous with the recess, thereby providing opening 18 in the bag through which air may be evacuated.

The device may further include depending wall 48 and preferably arcuate recess 46 in wall portion 40.

The lower portion of wall 48 desirably is similar in shape to the lower portion of wall 12, including recesses 37 parallel to recesses 36.

Figure 4:
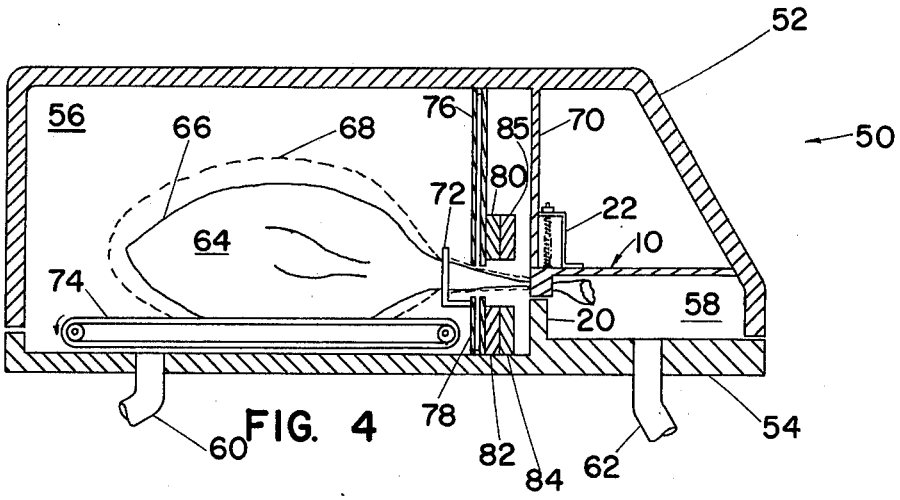
FIG. 4 is a sectional elevation view illustrating a preferred embodiment of the improved apparatus of this invention including the adjustable sealing device as a component thereof, with a filled bag in position to be evacuated.

In FIG. 4 improved double chamber vacuumizing apparatus 50 including the adjustable sealing device as a component thereof is shown in a side elevational representation with a side wall of the apparatus cut away so that the interior arrangement may be clearly seen. Also shown therein is a filled or product containing bag in position to be evacuated by the apparatus. The apparatus exclusive of the present improvement thereover is illustrated and described in the above-cited U.S. Pat. No. 3,832,824 to Burrell, which is incorporated herein in pertinent part by reference. Apparatus 50 includes cover 52 hinged to base member 54 which is divided by lower chamber divider wall 20. Upper divider wall 70 cooperates with the wall 20 to separate apparatus 50 into two chambers or regions 56 and 58. The first and larger region or chamber 56 is the product chamber in which the portion of a receptacle illustrated by bag 66 containing a product 64 is placed on product conveyor 74. The receptacle opening or bag neck is extended into the second and smaller region 58 which serves as the receptacle or bag evacuation chamber. The second chamber is evacuated through vacuum port 62 and the first chamber is evacuated through vacuum port 60.

Figure 5:
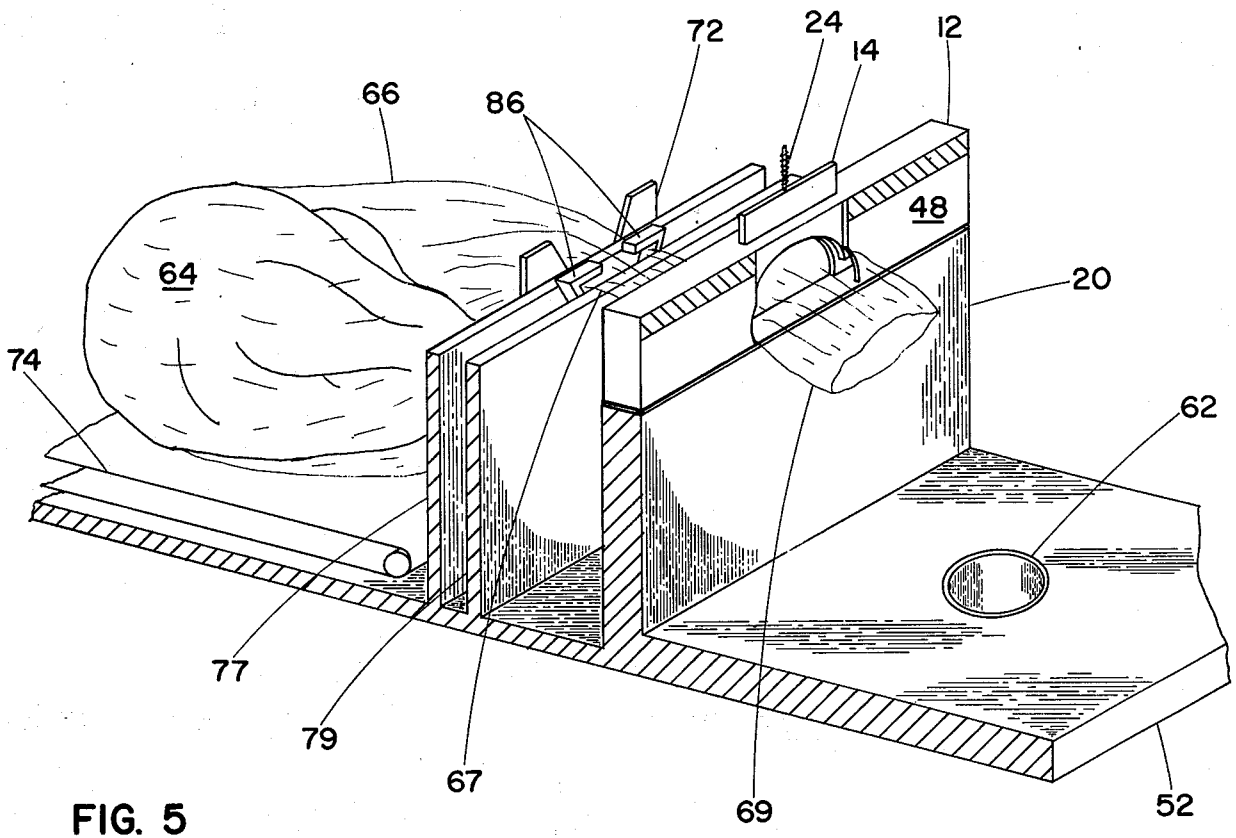
FIG. 5 is a fragmentary perspective view, partly in section, illustrating the lower portion of the improved apparatus of FIG. 4 with the adjustable sealing device atop a lower wall and a product containing bag of intermediate size in position to be evacuated with the bag neck received through the device in sealed relation thereto.

Referring generally to FIG. 4 and FIG. 5, the operator of the vacuumizing apparatus receives bag 66 containing the product and places the bag on the product conveyor 74, brings the neck of the bag down through the bag neck guide 72, and extends the neck of the bag across walls 77 and 79 of the gathering arm track 78, across plunger housing 82, cutter housing 84, and atop wall 20 so that the bag opening 69 of the package being formed is located in the second region or chamber 58 provided with evacuation port 62. Wall 70 cooperates with wall 20 to form a composite wall which divides the chambers. The chamber dividing wall is completed when the cover is rotated into the position shown in FIG. 4. By the improvement of this invention the dividing wall includes an adjustable aperture provided by the gate and wall of the device.

After the chamber is closed evacuation of the product containing chamber begins through vacuum port 60 by means of any suitable vacuum pump (not shown) connected thereto. Typically, as a vacuum is drawn the chamber is evacuated rapidly, for example in about two to three seconds, to a low pressure level which may be about 27 inches of Hg vacuum or other pressure level, as desired. Inclusion of the adjustable sealing device results in the bag neck sufficiently filling and sealing about the aperture between the chambers so that very little air is leaked from the second region 58 into the first region 56 during this phase of evacuation without concern for the size of the bag neck. In this initial phase, a difference in pressure is established between the interior of the bag and the product containing chamber, effecting outward ballooning of the bag as shown by dotted line 68.

The outward expansion or ballooning of the bag also occurs in the bag neck region and the expanded neck further seals the aperture between the chambers. While the bag is ballooned into shape 68, evacuation of the second region is initiated and continued for a suitable period, for example about ½ second. Typically, evacuation of the smaller second chamber proceeds at a more rapid rate than evacuation of the first chamber and overtakes the vacuum level thereof, thus causing the expanded bag to begin to collapse back onto the product. The second chamber may reach a vacuum level of 28 inches of Hg or lower, depending on the period of time air is withdrawn through port 62 by means of any suitable source of vacuum (not shown) connected thereto. As the vacuum level in the second chamber is reduced below that in the first or product containing chamber and the bag begins to collapse back upon the product, atmospheric pressure may be restored in the first chamber by stopping the vacuum pumping action through port 60 and opening the chamber to the atmosphere by valve means not shown. The resulting increase in the pressure differential between the inside and outside of the bag aids in collapsing the bag rather rapidly and suddenly driving out any remaining air. The bag is thereafter clipped and closed as will be described more fully hereinafter.

After the bag is clipped and closed, the excess bag neck material may be trimmed off and the head or cover is opened. Movement of the conveyor may thereafter be effected to remove the sealed bag from the vacuumizing apparatus, during which time the operator may place another filled bag within the apparatus to repeat the process.

When, as described above, the bag is expanded outwardly, the bag wall is separated from the product 64. Crevices or cavities in the product are thereby exposed to the space which now exists between the product and the expanded bag wall 68 (FIG. 4). Thus, when evacuation of the second chamber begins, a continuous passageway extends from a substantial portion of the surface of the product to the second chamber, whereby the substantial product surface is brought directly under the influence of the vacuum being drawn through the second chamber.

Improved vacuumizing apparatus 50 includes preferred receptacle closing means including pivotally opposed gathering arms 86 adapted to move inwardly towards each other to gather or compress the bag neck after a suitable level of receptacle evacuation is effected. After the gathering arms have wedged the bag neck into a smaller space, a plunger housed in the plunger housing drives a clip up around the gathered portion of the bag neck towards anvil 80. Further motion of the plunger forces the clip to the anvil which cooperates with the plunger to bend the clip securely around the gathered bag neck, thereby closing and sealing the bag. After clipping is completed a cutter blade is driven upwardly from cutter housing 84 to cut off the excess bag material which extends beyond the clip. The clip may be supplied from a group of clips contained in a clip magazine illustrated in FIG. 7 of the above-cited Burrell patent. The clips are urged forward in the magazine under the influence of a clip spring and are delivered to the plunger 24 immediately below the plunger housing. The plunger illustrated therein is connected to a plunger crank arm at a pivot, the crank arm being driven by a timing wheel to which it is connected by a crank pin.

The cutter blade is driven by any suitable means, which may be a pneumatically operated cylinder or an electrically driven solenoid, both of which drive means are well known in the art.

The improved vacuumizing apparatus may include other means for closing a receptacle or bag after evacuation, for example, a sealing bar assembly including a backing member and a heated bar. This assembly may be substituted for the cutter blade and cutter guide described above. The sealing bar may be of any suitable width, e.g. the width of the receptacle neck or more. The sealing bar may be electrically resistance heated and when the bar is moved adjacent the backing member, the bar presses a flattened bag neck against the backing member. The bar dwells sufficiently long in its sealing position so that the bag is sealed to itself. This closing means is suitable for closing bags of heat sealable material, including polyethylene, ethylene vinyl acetate copolymers, saran, and the like.

The improved vacuumizing apparatus may be operated in semi-automatic manner substantially as described in the above-cited Burrell patent.

Figure 3:
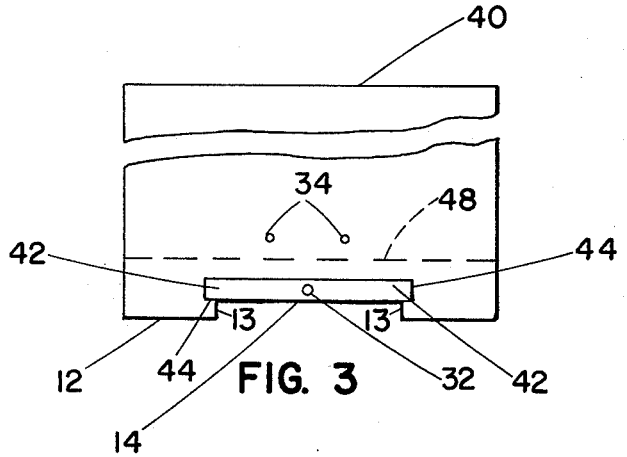
FIG. 3 is a top view of the device with the mounting assembly removed.

As shown in FIG. 4, the improved vacuumizing apparatus includes sealing device 10 which provides the aperture means connecting the chambers, which aperture means may be a wall having an aperture therein through which a portion of a receptacle containing an opening may be passed. In an aspect of the apparatus of the above-cited Burrell patent, the lower wall separating the chambers includes a recess. In this aspect of the Burrell apparatus, the apparatus is improved by including therein the above-described embodiment of the present adjustable sealing device having a recess, corresponding to recess 15, disposed in the lower wall portion 20 and included in the aperture defined in part by surfaces 13 (FIGS. 1–3). As illustrated by FIG. 5, the process of the Burrell patent is improved by separating the first and second regions, at least in part, by adjustable sealing device 10 with a connecting portion of the receptacle received through the adjustable aperture of the device.

Figure 6:
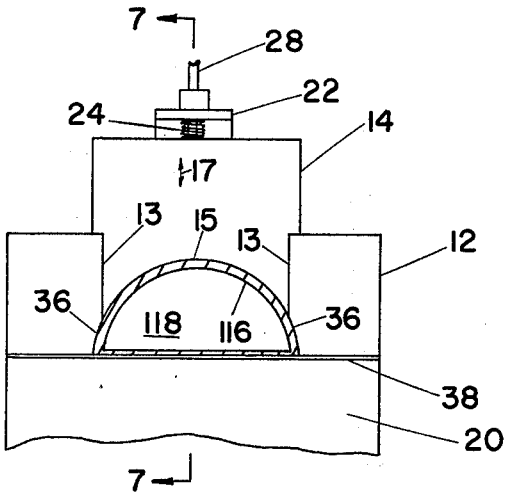
FIG. 6 is an elevation view illustrating the adjustable sealing device with a large bag neck received in sealed relation through the device.
Figure 7:
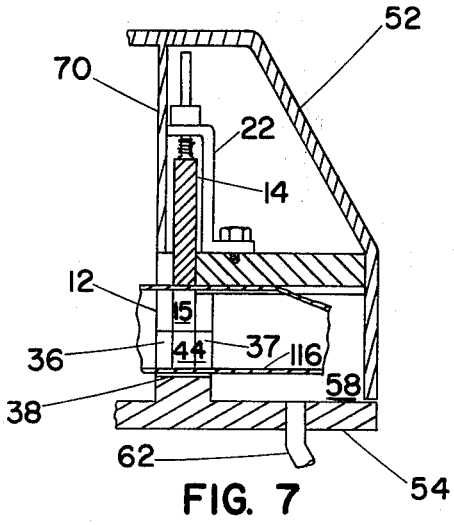
FIG. 7 is a section view of the device taken on line 7—7 of FIG. 6, in combination with a portion of the improved apparatus of FIG. 4 shown in fragmentary section.

Operation of the present adjustable sealing device is further illustrated in FIG. 6 and FIG. 7. Therein the gate 14 is shown in a raised position exposing a larger portion of the aperture and providing a larger opening through the device, the opening being defined by arcuate recess 15 disposed in the gate, arcuate ends 36 of wall surfaces 13 and an upper surface of wall 20 having gasket 38 thereon. Received through the opening is the relatively large neck 116 of a bag which may contain a product to be packaged in the improved apparatus or by the improved process of this invention. The bag neck is shown in expanded condition corresponding to a portion of bag shape 68 (FIG. 4), with the bag in substantially sealed engagement with the surfaces defining the opening, thereby providing a larger passage and more efficient evacuation opening 118 than is provided by a small fixed size aperture of the size indicated by the bag-filled opening shown in FIG. 1.

The gate may be moved to the position shown in FIG. 6 and FIG. 7 by hand or other suitable means. It is found that the gate is simply and efficiently moved into suitable sealing engagement with bag necks throughout a broad range of neck size by lowering the device onto a bag positioned across the top of the lower wall as shown in FIG. 7. Preferably, the gate is of lightweight construction and the biasing means, where included, is of relatively low strength, thereby readily establishing an equilibrium condition with the received bag neck. This equilibrium condition is characterized in that the resiliency of the bag neck offsets the slight biasing force of the spring having a suitably low spring constant or other suitable bias means, whereby the gate self-adjusts to an effective neck sealing position such as the raised position shown in FIG. 6 for the bag neck of the relative size shown therein.

The guide means for guiding the gate illustrated in the drawing may include the generally U-shape channels 44 (FIGS. 1–3) and the mounting assembly including pin 28 which is slidably received through the spring stop. Other suitable guide means may be included.

The seal means for forming a seal between the gate and the wall about the aperture may include sealingly mating surfaces on the U-shape channels and the adjacent gate portions. The seal means may further include optionally included depending wall 40. It is found that generation of a pressure differential across the gate aids in forming a seal between wall 40 and the gate. A suitable pressure differential for aid in sealing the gate and wall is typically established using the improved vacuumizing apparatus described above. Any suitable seal means may be included.

After the gate is in suitable position for the size of bag neck received therethrough, vacuumizing of the product containing portion of the bag expands the bag neck into a suitable position, illustrated by bag neck 116 in FIG. 7. Subsequent evacuation of the bag interior with maximum evacuation efficiency is thereby effected over a broad range of bag neck sizes.

Eminently suitable packages may be prepared by the process and apparatus of this invention with meat or poultry enclosed by a heat shrinkable, substantially gas impervious, thermoplastic bag. After the product has been sealed in the bag and the resulting package conveyed out of the apparatus, the package is heated, as by means of a hot water bath or hot air tunnel, to shrink and further tighten the bag material around the product. The tight grip of the shrunken material aids in protecting major portions of the product from pinhole leakage.

It is to be understood that the present invention is not limited to bags and pouches but can be applied to any suitable receptacle which will flex outwardly under the influence of a pressure differential and will conform to a wall aperture.

It is to be understood that the foregoing detailed description is given merely by way of illustration and that many variations may be made therein without departing from the spirit or scope of the present invention.

I claim:

1. In an apparatus for evacuating and closing flexible, impervious receptacles such as pouches, bags and the like which have at least one opening and contain at least one product, said apparatus comprising:

A. a first vacuum chamber;

B. a second vacuum chamber adjacent to said first chamber;

C. means providing an aperture in flow communication with said chambers for passing a portion of said receptacle containing the opening through the aperture;

D. means to evacuate said first and second chambers independently of each other and to evacuate said receptacle; and, E. means to close said receptacle when its evacuation is completed, the improvement for effecting an improved seal between said chambers throughout a range of receptacle size wherein said aperture-providing means includes means for adjusting the size of said aperture to substantially preclude flow communication of the first and second chambers other than flow communication through said opening in the receptacle, said means for adjusting the size of said aperture including a gate adapted to traverse said aperture.

2. In an apparatus for evacuating and closing flexible, impervious receptacles such as pouches, bags and the like which have at least one opening and contain at least one product, said apparatus comprising a first vacuum chamber; a second vacuum chamber adjacent to said first chamber; aperture means connecting said chambers for passing the portion of said package containing an opening therethrough; means to evacuate said first and second chambers independently of each other; and means to close said receptacle when its evacuation is completed; the improvement for effecting an improved seal between said chambers throughout a range of receptacle size wherein said aperture means includes an adjustable sealing device for sealably receiving a flexible receptacle, said device comprising, in combination:

a. a wall having an aperture disposed therethrough;
b. a gate for closing variable portions of the aperture, said gate being movably received adjacent the wall and adapted to traverse the aperture, said gate having a recess adapted to traverse the aperture simultaneously with traverse thereof by the gate, said recess adapted to cooperate with the aperture to form a variable size opening through the device, said opening being effective to receive a receptacle therethrough and being sealable by the receptacle;
c. seal means for forming a seal between the gate and the wall about the aperture; and
d. guide means for guiding the gate in a traverse of the aperture.

3. The improvement of claim 2 wherein the guide means comprises first and second generally U-shape channels disposed in the wall, said gate being movably received by the channels.

4. The improvement of claim 3 wherein the seal means comprises a surface of said gate adapted to sealingly engage said channels.

5. The improvement of claim 2 wherein the recess is generally arcuate.

6. In an apparatus for evacuating receptacles into which a product has been loaded comprising a first vacuum chamber for receiving the product containing portion of said receptacle; a second vacuum chamber adjacent to said first chamber; a wall separating said chambers, said wall having an aperture therein through which a portion of a receptacle containing an opening may be passed; means for evacuating and venting the first and second chambers independently of each other; and closing and sealing means within said first chamber to close said receptacle after evacuation; the improvement for effecting an improved seal between said chambers throughout a range of receptacle size wherein said wall includes an adjustable sealing device for sealably receiving a flexible receptacle, said device comprising, in combination:

a. a gate for closing variable portions of the aperture, said gate being movably received adjacent the wall and adapted to traverse the aperture, said gate having a recess adapted to traverse the aperture simultaneously with traverse thereof by the gate, said recess adapted to cooperate with the aperture to form a variable size opening through the device, said opening being effective to receive a receptacle therethrough and being sealable by the receptacle;
b. seal means for forming a seal between the gate and the wall about the aperture; and
c. guide means for guiding the gate in a traverse of the aperture.

7. The improvement claim 6 wherein the guide means comprises first and second generally U-shape channels disposed in the wall, said gate being movably received by the channels.

8. The improvement of claim 7 wherein the seal means comprises a surface of said gate adapted to sealingly engage said channels.

9. The improvement of claim 6 wherein the recess is generally arcuate.

10. In an apparatus for evacuating filled receptacles such as bags, pouches, and the like comprising (A) a base member divided into first and second chamber bases by a lower wall, said first chamber base being larger than said second base; (B) a cover member hingedly attached to said base member, said cover member being divided by an upper wall into first and second chamber heads; (C) a first recess in the upper edge of said lower wall; (D) a second recess in the lower edge of said upper wall, said recesses being complementary whereby when said cover member is rotated to a closed position first and second vacuum chambers are formed by the mating of said upper and lower walls and an aperture between said chambers is formed by said complementary recesses; (E) a vacuum port in said first chamber; (F) a vacuum port in said second chamber; (G) vacuumizing means in communication with each of said ports; (H) control means whereby at least one of said chambers may be evacuated and restored to atmospheric pressure independently of the other chamber; and (I) receptacle closure means within said first chamber to seal said receptacle after evacuation has been completed; the improvement for effecting an improved seal between said chambers throughout a range of receptacle size wherein said upper wall includes an adjustable sealing device for sealably receiving a flexible receptacle, said device comprising, in combination:

a. a gate for closing variable portions of the aperture, said gate being movably received adjacent the upper wall and adapted to traverse the aperture, said gate having a third recess adapted to traverse the aperture simultaneously with traverse thereof by the gate, said third recess adapted to cooperate with the aperture to form a variable size opening through the device, said opening being effective to receive a receptacle therethrough and being sealable by the receptacle;
b. seal means for forming a seal between the gate and the upper wall about the aperture; and
c. guide means for guiding the gate in a traverse of the aperture.

11. The improvement of claim 10 wherein the guide means comprises first and second generally U-shape channels disposed in the third wall, said gate being movably received by the channels.

12. The improvement of claim 11 wherein the seal means comprises a surface of said gate adapted to sealingly engage said channels.

13. The improvement of claim 10 wherein said third recess is generally arcuate.

* * * * *